US006302803B1

(12) United States Patent
Barlow

(10) Patent No.: US 6,302,803 B1
(45) Date of Patent: Oct. 16, 2001

(54) PORTABLE GOLF PUTTING GREEN

(76) Inventor: David R. Barlow, 7620 Harborview Way N., Seminole, FL (US) 33776

( * ) Notice: Subject to any disclaimer, the term of this patent is extended or adjusted under 35 U.S.C. 154(b) by 0 days.

(21) Appl. No.: 09/493,365

(22) Filed: Jan. 28, 2000

(51) Int. Cl.[7] ..... A63B 69/36
(52) U.S. Cl. ..... 473/162; 473/160
(58) Field of Search ..... 473/157, 159, 473/160, 171, 181, 162, 161, 278, 279

(56) References Cited

U.S. PATENT DOCUMENTS

| | | | | |
|---|---|---|---|---|
| 1,914,365 | * | 6/1933 | Ford | 473/157 |
| 2,515,847 | | 7/1950 | Winkler . | |
| 3,661,687 | | 5/1972 | Spinney, Jr. et al. . | |
| 3,669,454 | | 6/1972 | Kolonel . | |
| 3,715,123 | | 2/1973 | Baum . | |
| 3,727,918 | | 4/1973 | Zawacki . | |
| 3,743,295 | | 7/1973 | Flowers . | |
| 3,871,650 | * | 3/1975 | Casey | 473/160 |
| 4,202,547 | * | 5/1980 | Mueller | 473/181 |
| 4,211,417 | * | 7/1980 | Brown | 473/160 |
| 5,007,644 | * | 4/1991 | Bluthardt et al. | 473/157 |
| 5,366,224 | * | 11/1994 | Stanwyck et al. | 473/157 |
| 5,916,034 | | 6/1999 | Lancia . | |

* cited by examiner

*Primary Examiner*—Mark S. Graham
(74) *Attorney, Agent, or Firm*—Larson & Larson, P.A.; James E. Larson

(57) ABSTRACT

Multiple panels, each having a bottom layer of a ribbed rigid polymer bonded to a top layer of a plastic sheet, bonded in turn to an outdoor carpet are joined together by a latch assembly positioned in openings on a side surface of the panels. An ornamental vacuum formed polymer edge to the top layer of plastic sheet surrounds the outer portion of each panel. At least one panel has a through hole in the carpet, top layer and the bottom layer filled with a cup for receipt of a putted golf ball. The bottom surface of the joined panels rests on a substrate such as soil, cement, crushed stone or sand.

17 Claims, 5 Drawing Sheets

PORTABLE GOLF PUTTING GREEN

FIELD OF THE INVENTION

This invention relates to miniature golf putting greens. More particularly, it refers to a portable sectional golf putting green wherein sections are held together by cam locking fasteners.

BACKGROUND OF THE INVENTION

It is common in the miniature golf hole courses found in amusement facilities to construct a cement foundation base covered with outdoor carpeting. Obviously such courses are not portable and cannot be disassembled and moved to a different location. Recently, miniature golf hole systems have been constructed from an expanded polystyrene foam base as shown in U.S. Pat. No. 5,916,034. The polystyrene base is covered with a porous rubberized material and this rubberized material is covered with outdoor carpeting. This type of system facilitates drainage of the carpet surface but is so massive in structure as to foreclose its easy movement to a substitute location. Backyard golf enthusiasts wish to have a single golf green to which they can chip and on which they can practice putting. However, multiple uses for limited backyard space forecloses the construction of a permanent putting green as shown in U.S. Pat. No. 5,916,034. Homeowners wish to be able to disassemble the putting greens and store them when not in use so backyard areas can be used for alternate purposes. Therefore, a need arises for a portable golf course green.

SUMMARY OF THE INVENTION

I have invented a portable golf course green having multiple sections that can be readily locked together and covered with outdoor carpeting to create a chipping and putting green. The portable putting green can be easily disassembled and stored when not in use by rolling up the outdoor carpet and detaching the sectional pieces. Each sectional piece includes a polymeric bottom ribbed layer that is in contact with a substrate. Glued or otherwise attached to the bottom ribbed section is a top sheet of ABS plastic. The outdoor carpet is cut and rolled over the top sheet to form the putting surface. A hole is formed in the carpet, top sheet, and the ribbed section to receive a cup adapted to accept a putted golf ball. Cammed locking fasteners are installed on a side surface of each mating section to engage a corresponding section. An allen wrench operates the fastener.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
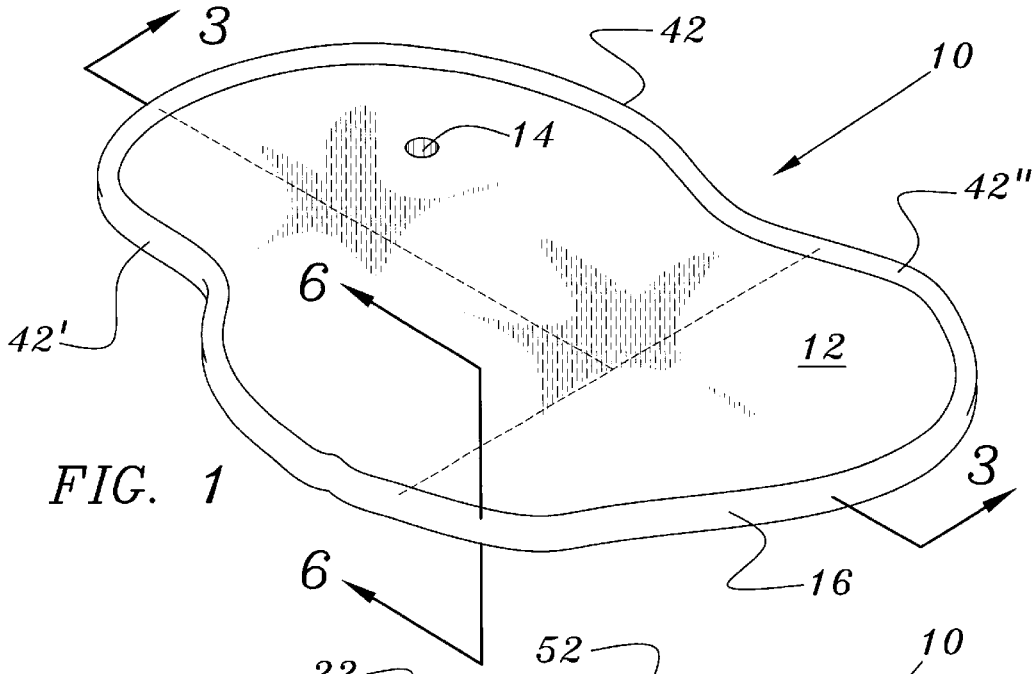
FIG. 1 is a top perspective view of the portable golf putting green of this invention.

Throughout the following detailed description, the same reference numerals refer to the same elements in all figures.

Figure 5:
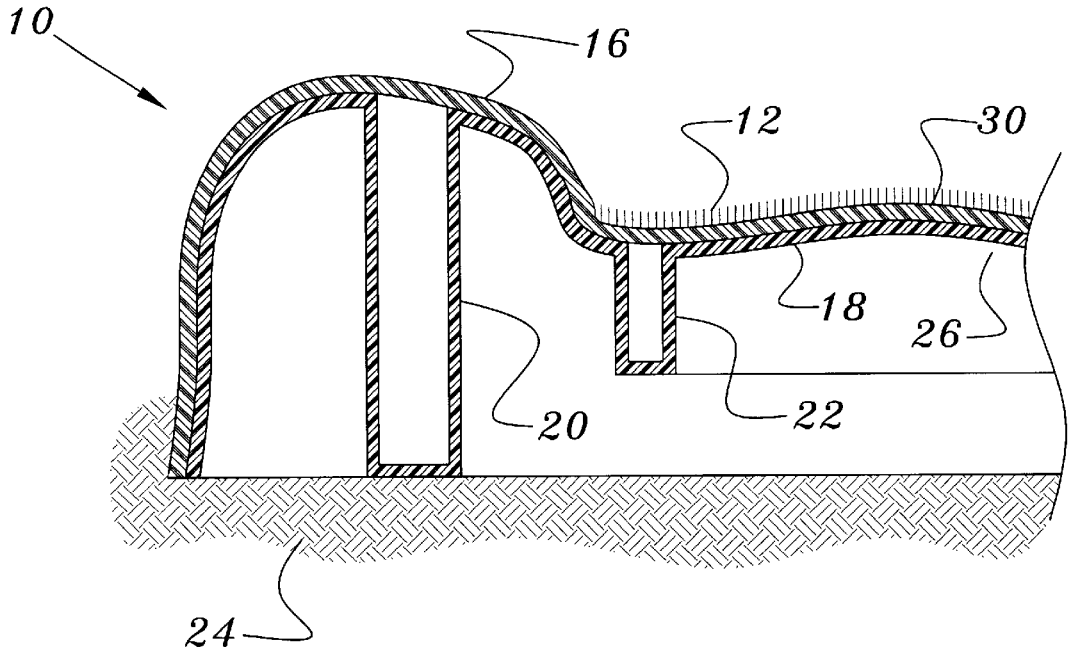
FIG. 5 is an elevational sectional view along line 6—6 of FIG. 1.

The portable golf putting green 10 shown in FIG. 1 is a one piece vacuum formed multilayer plastic unit covered by an undulating outdoor carpeting surface 12 penetrated by a hole 14 in which golf cup 36 is inserted. An exterior ornamental roundabout component 16 which is the edge of layer 26 is raised above the surface 12 so that golf balls will not roll off the green once on surface 12. As seen in FIG. 5, the putting green 10 has an undulating preformed bottom polymeric layer 18. Layer 18 contains integral molded downwardly directed ribs 20 and cross-linking ribs 22. Ribs 20 partially rest on a substrate such as soil 24. The substrate also can be a concrete pad, crushed stone or sand.

A sheet of undulating ABS polymer 26 conforming to the undulations on the top surface of bottom layer 18 is glued to a top surface of layer 18. The outdoor carpeting 12 is glued to a top surface 30 of the layer 26. Layers 18 and 26 can be made from any impact resistant plastic that is vacuum formable such as ABS, polycarbonate, polyvinyl chloride or polyvinyl styrene.

Figure 6:
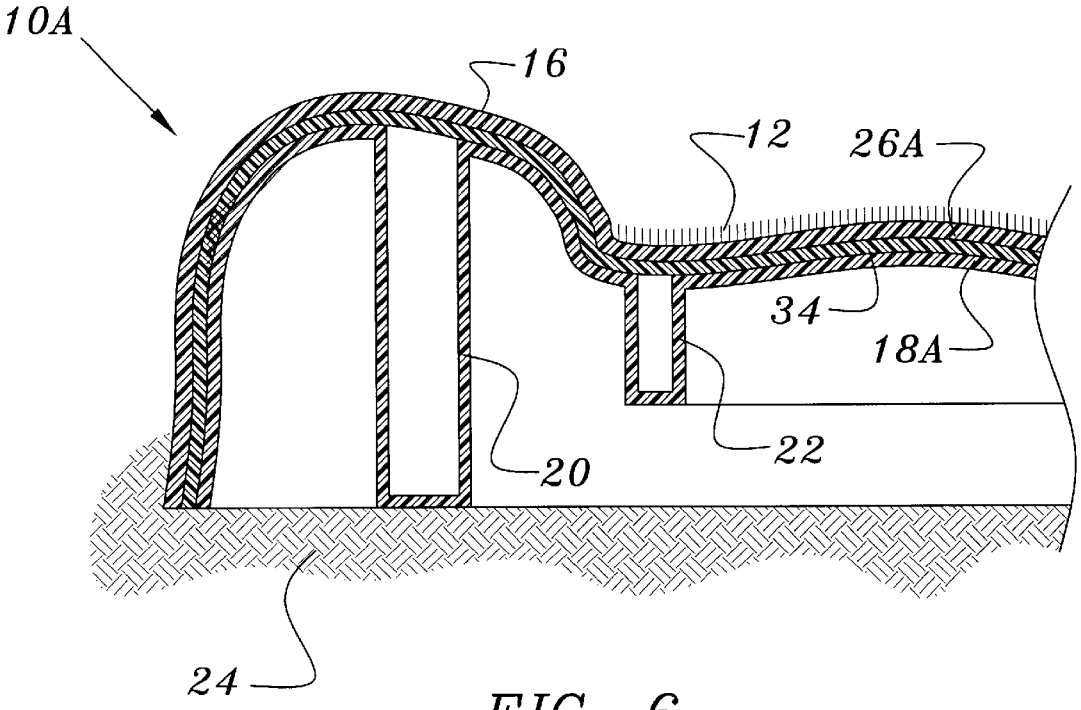
FIG. 6 is an elevational sectional view of an alternative three layers of supporting structure.
Figure 7:
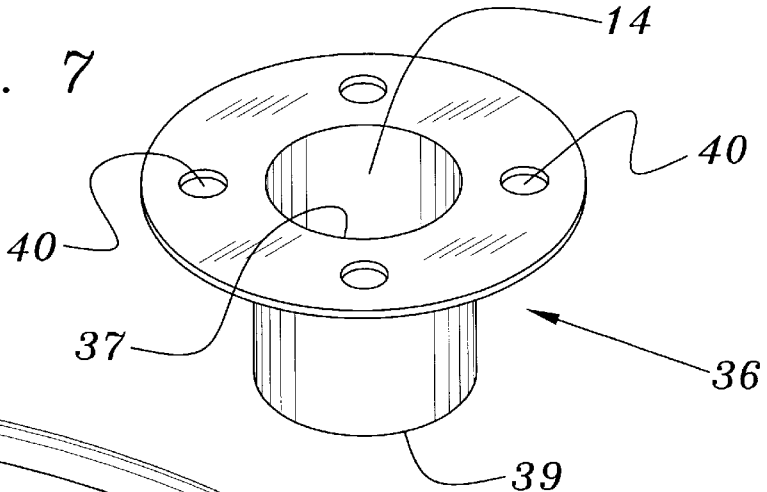
FIG. 7 is a perspective view of the golf ball cup installed on the putting surface.

FIG. 6 shows an alternate embodiment putting green 10A which has an additional polymeric layer 34 glued between layers 18A and 26A to add additional strength to the golf putting green 10.

The golf hole 14 is formed by drilling a hole through layers 12, 18 and 26 conforming about in diameter to hole 14. A vacuum formed cup 36 having an open top 37 and closed bottom 39 is inserted in the hole 14 and flange 38 is bolted to the layers 18 and 26 with flat head bolt (not shown) through bolt holes 40. The outdoor grass 12 is cut out usually by a laser so as to cover flange 38 and leave open top 37 uncovered for receipt of a golf ball into cup 36.

Figure 2:
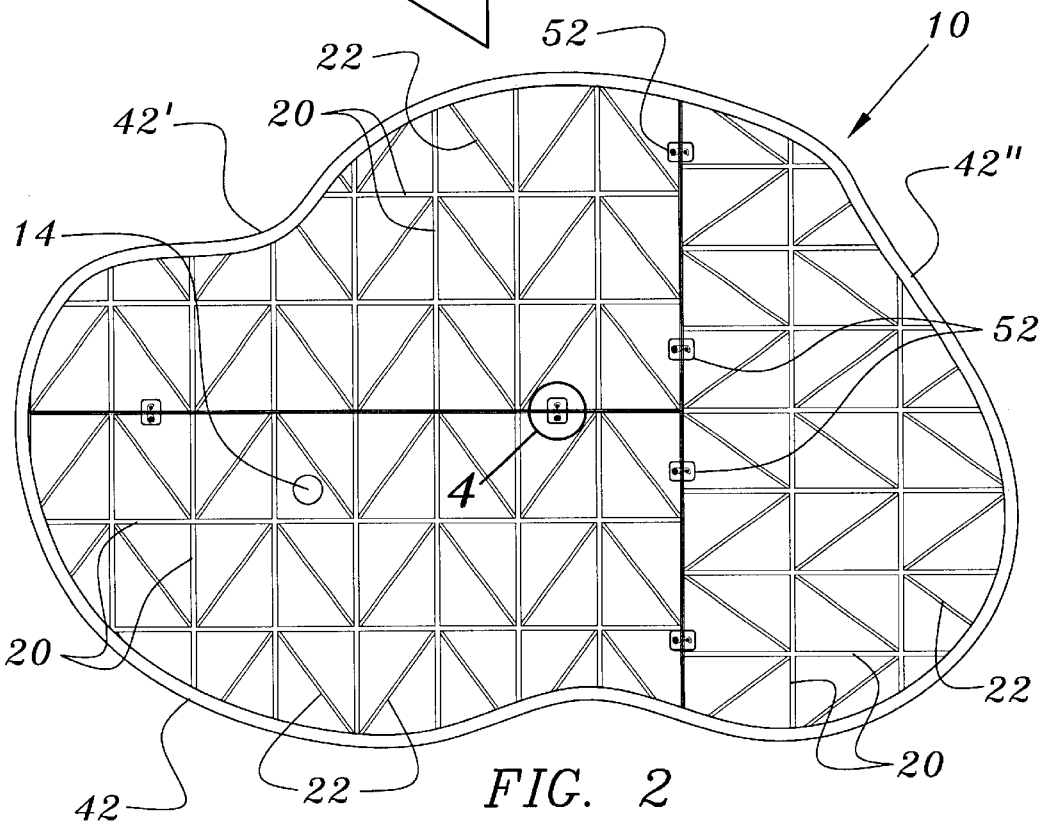
FIG. 2 is a bottom plan view thereof.
Figure 3:
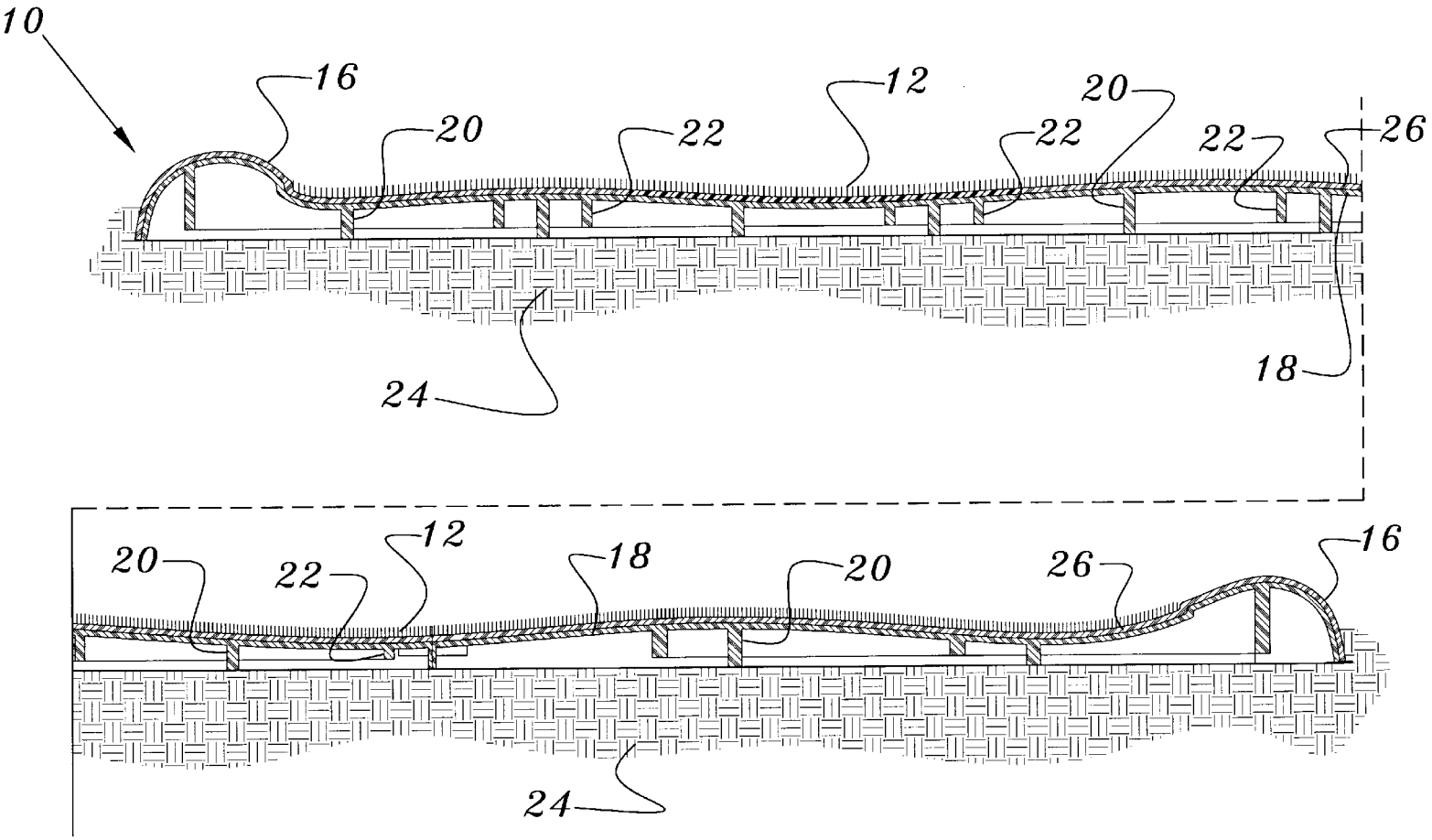
FIG. 3 is a side partial sectional view along line 3—3 of FIG. 1.
Figure 4:
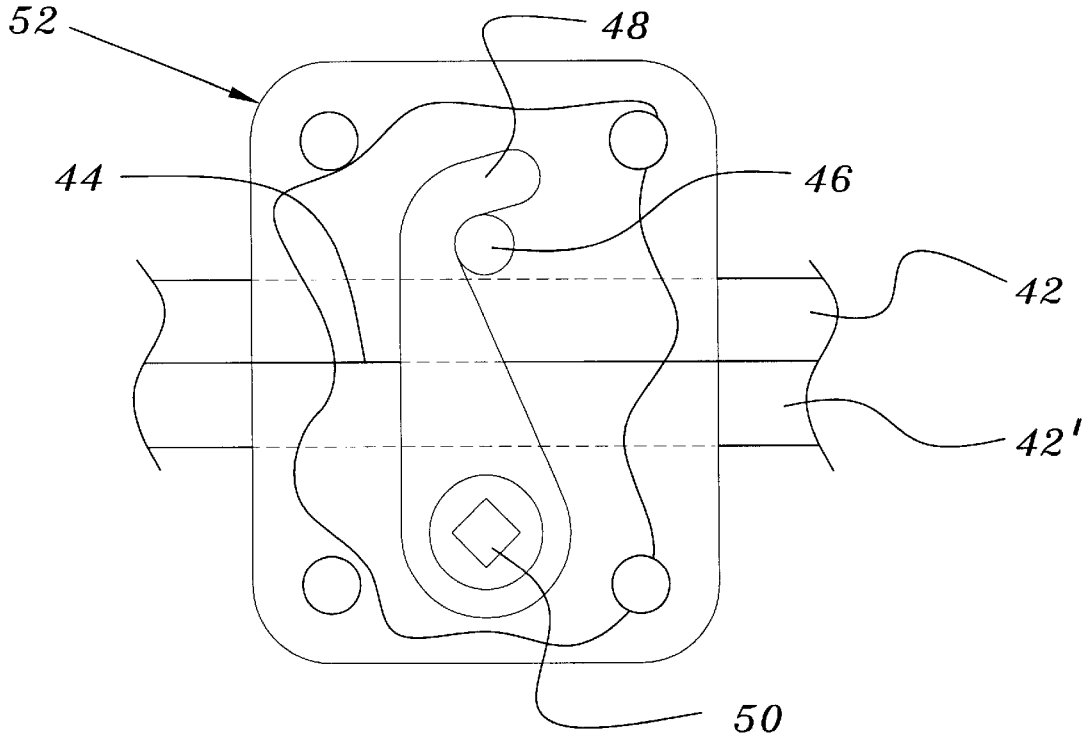
FIG. 4 is a cutaway view of the cam lock fastener.
Figure 8:
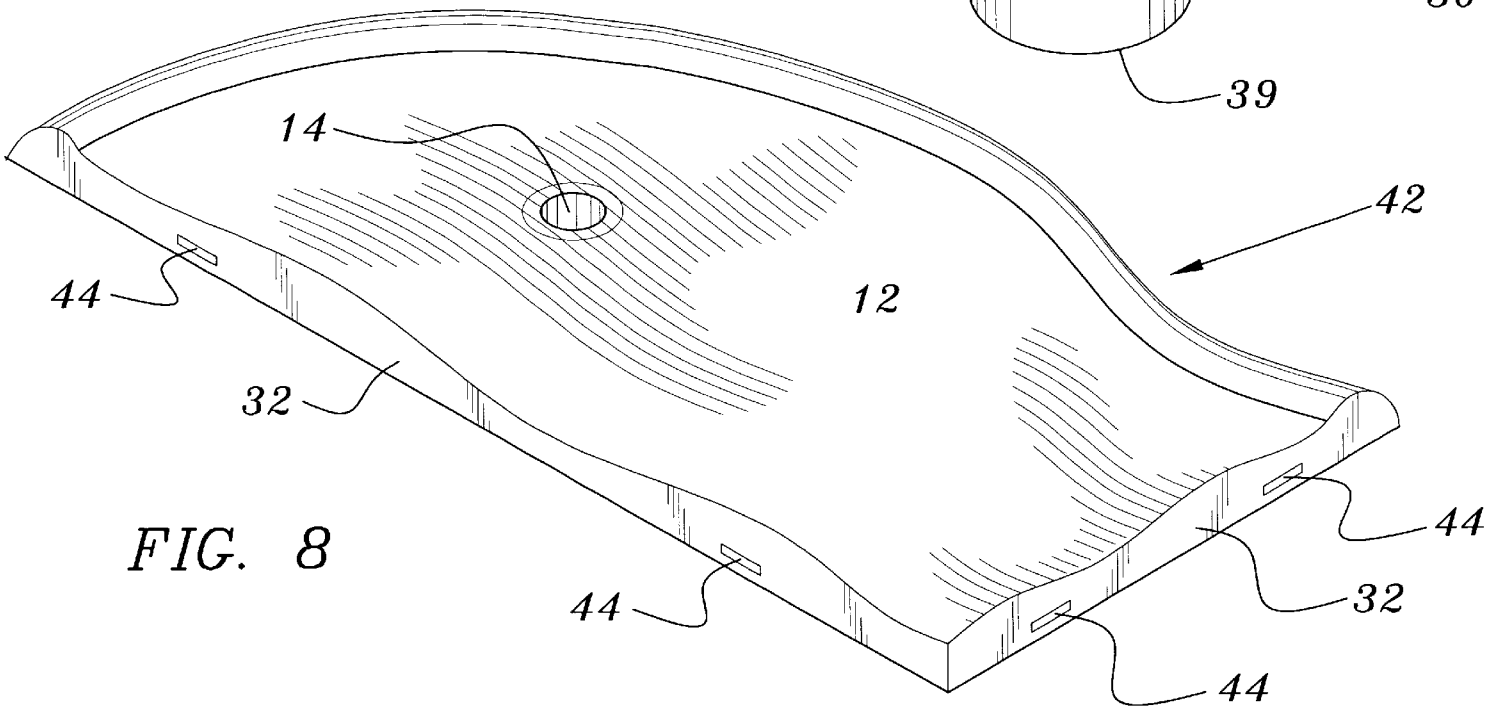
FIG. 8 is a top view of an unattached panel with the ball hole visible.

Each panel 42 is vacuum formed starting with a 4×8 sheet of layers 18, 26 and 12 glued together. FIG. 8 shows a typical formed panel 42 having latch openings 44 on side surfaces 32. Inside the opening 44 is a bar 46 that is engaged by a cam 48 from an opening in an adjacent panel 42'. An allen wrench entrance 50 provides a means for turning the cam 48 to either latch or unlatch the panel from bar 46. FIG. 2 shows three panels latched together; namely, 42, 42' and 42" and FIG. 4 shows the latch assembly 52.

In a preferred embodiment, three panels 42, 42' and 42" are latched together with latch assembly 52 as shown in FIGS. 1 and 2 to form the portable golf putting green 10. The downwardly directed projections or molded ribs 20 are resting on substrate such as soil 24. The top carpet layer 12 is 3/16 inch thick green ABS plastic, the middle sheet 26 is a ¼ inch thick expanded polyvinyl chloride and the bottom layer 18 is a black ABS plastic. The ribs 20 and 22 are about two inches wide and have a pattern as shown in FIG. 2. A ½ inch rise of the polymeric ornamental roundabout 16 as the edge of layer 26 projects above surface layer 12 to keep the ball on the artificial carpeting or grass. It is preferred to laser cut the outdoor carpeting 12 to have sharp edges and abut the roundabout 16 at a 90° angle. Drain holes (not shown) can be drilled adjacent the roundabout 16 through layers 12, 18 and 26 to provide water drainage.

The above description has described specific structural details embodying the invention. However, it will be within one having skill in the art to make modifications without departing from the spirit and scope of the underlying inventive concept of this portable golf putting green. The inventive concept is not limited to the structure described, but includes such modifications except as limited by the scope of the appended claims.

Having thus described the invention, what is claimed and desired to be secured by Letters Patent is:

1. A portable golf putting green for use over a substrate, the putting green having multiple panels mechanically fastened together, each panel comprising:

a first vacuum formable polymeric layer having integrally molded ribs descending from an undulating bottom surface, the first layer adapted for mounting over the substrate, a second vacuum formable polymeric layer bonded at a bottom surface to a top surface of the first layer and conforming in an undulating pattern to the first layer, an outer edge of the second layer forming an ornamental border, a third outdoor rug layer simulating a putting surface, a bottom surface of the rug layer bonded to a top surface of the second layer, an edge of the rug layer abutting the ornamental border, a golf green cup mounted through the first, second and third layers adapted to receive a golf ball, the ornamental border abutting an outer periphery of the third outdoor rug layer to contain golf balls within the putting green.

2. The portable golf putting green according to claim 1 wherein the integral molded ribs descending from a bottom surface of the first polymeric layer are adapted for embedding in a soil area.

3. The portable golf putting green according to claim 1 wherein a side surface of each opposing panel fastened together has an opening containing a complimentary cam or latch bolt to fasten the panels together.

4. The portable golf putting green according to claim 3 wherein the cam is turned by an allen wrench inserted in a hole at one end of the cam.

5. The portable golf putting green according to claim 1 wherein a fourth layer of a vacuum formed polymeric sheet is bonded between the second polymeric layer and the third outdoor rug layer.

6. The portable golf putting green according to claim 1 wherein multiple drain holes are drilled through the three layers adjacent the ornamental border.

7. A portable golf putting green having at least three panels mechanically fastened together, each panel comprising:

a first polymeric layer having integrally molded ribs descending from an undulating bottom surface, the first layer adapted for mounting over a substrate, a second polymeric layer having a bottom surface and top surface, the second polymeric layer conforming in an undulating pattern to the first layer, a third outdoor rug layer having a bottom surface and a top surface, the top surface simulating a putting green surface, the bottom surface bonded to the top surface of the second polymeric layer and the bottom surface of the second polymeric layer bonded to a top surface of the first polymeric layer and a hole through the first, second and third layers adapted to receive a golf green cup.

8. The portable golf putting green according to claim 7 wherein an outer raised edge of the second polymeric layer surrounds an outer edge of the outdoor rug layer on the golf putting green to prevent golf balls from falling off the top surface of the golf putting green.

9. The portable golf putting green according to claim 7 wherein the substrate is adapted for mounting in soil.

10. The portable golf putting green according to claim 7 wherein a fourth polymeric layer is bonded between the second polymeric layer and the third outdoor rug layer.

11. The portable golf putting green according to claim 7 wherein the at least three panels are mechanically fastened together by a bar in a side surface of one panel latched to a movable cam in a side surface of an adjacent panel.

12. The portable golf putting green according to claim 11 wherein each panel has at least two openings in each side surface, each opening containing either a bar or corresponding movable cam to mechanically fasten to an adjacent panel.

13. The portable golf putting green according to claim 8 wherein the first and second polymeric layers and the border in each panel are made from an impact resistant vacuum formable polymer.

14. The portable golf putting green according to claim 13 wherein the polymer is selected from the group consisting of ABS, polycarbonate, polyvinyl chloride and polyvinyl styrene.

15. The portable golf putting green according to claim 13 wherein a third polymeric layer is formed with the first and second polymeric layers.

16. The portable golf putting green according to claim 7, wherein the at least three panels are mechanically fastened together by a latch assembly.

17. The portable golf putting green according to claim 16, wherein the latch assembly constitutes a complimentary movable cam and bar respectively in joined panels.

* * * * *